US005167872A

United States Patent [19]

Pancheri et al.

[11] Patent Number: 5,167,872

[45] Date of Patent: Dec. 1, 1992

[54] COMPRISING ANIONIC SURFACTANT POLYMERIC NONIONIC SURFACTANT AND BETAINE SURFACTANT

[75] Inventors: Eugene J. Pancheri, Montgomery; Mark H. K. Mao, Cincinnati, both of Ohio

[73] Assignee: The Procter & Gamble Company, Cincinnati, Ohio

[21] Appl. No.: 918,566

[22] Filed: Oct. 20, 1986

Related U.S. Application Data

[63] Continuation-in-part of Ser. No. 793,529, Oct. 31, 1985, abandoned.

[51] Int. Cl.[5] ..... C11D 1/90; C11D 1/44

[52] U.S. Cl. ..... 252/544; 252/525; 252/527; 252/529; 252/532; 252/539; 252/535; 252/548; 252/551; 252/554; 252/558; 252/DIG. 2; 252/DIG. 14

[58] Field of Search ..... 252/544, 525, 527, 529, 252/548, 532, 551, 535, 545, 554, 539, 558, DIG. 2, DIG. 13, DIG. 14

[56] References Cited

U.S. PATENT DOCUMENTS

| | | | |
|---|---|---|---|
| 3,671,634 | 6/1972 | Carlson et al. | 424/274 |
| 3,696,057 | 10/1972 | Schussler et al. | 252/544 |
| 3,728,264 | 4/1973 | Celia et al. | 252/90 |
| 3,738,943 | 6/1973 | Kaneko | 252/540 |
| 3,785,985 | 1/1974 | Grand | 252/106 |
| 3,856,711 | 12/1974 | Mausner et al. | 252/545 |
| 3,869,399 | 3/1975 | Collins | 252/118 |
| 3,928,251 | 12/1975 | Bolich et al. | 252/545 |
| 3,950,417 | 4/1976 | Verdicchio et al. | 252/545 |
| 3,962,150 | 6/1976 | Viola | 252/542 |
| 3,962,418 | 6/1976 | Birkofer | 424/70 |
| 4,316,824 | 2/1982 | Pancheri | 252/551 |
| 4,329,334 | 5/1982 | Su et al. | 424/70 |
| 4,430,237 | 2/1984 | Pierce et al. | 252/173 |
| 4,450,091 | 5/1984 | Schmolka | 252/174.21 |
| 4,490,279 | 12/1984 | Schmolka | 252/357 |
| 4,492,646 | 1/1985 | Welch | 252/528 |
| 4,554,098 | 11/1985 | Klisch et al. | 252/547 |
| 4,554,495 | 10/1985 | Schmolka | 252/174.21 |
| 4,555,360 | 11/1985 | Bissett et al. | 252/541 |
| 4,678,606 | 7/1987 | Akhter et al. | 252/542 |

FOREIGN PATENT DOCUMENTS

| | | |
|---|---|---|
| 83223 | 7/1983 | European Pat. Off. . |
| 38508 | 3/1977 | Japan . |
| 34306 | 3/1979 | Japan . |
| 157110 | 12/1979 | Japan . |
| 158408 | 12/1979 | Japan . |
| 209999 | 12/1982 | Japan . |
| 7408904 | 1/1975 | Netherlands . |

OTHER PUBLICATIONS

A technical data sheet on Pluronic surfactants from Wyandotte.

*Primary Examiner*—Prince Willis, Jr.

*Attorney, Agent, or Firm*—Robert B. Aylor; Gretchen R. Hatfield; Donald E. Hasse

[57] ABSTRACT

High sudsing liquid detergent compositions contain anionic surfactant, polymeric surfactant which contains either linkages and a betaine surfactant for improved grease handling.

6 Claims, No Drawings

COMPRISING ANIONIC SURFACTANT POLYMERIC NONIONIC SURFACTANT AND BETAINE SURFACTANT

CROSS REFERENCE TO RELATED CASES

This is a continuation-in-part of our copending application Ser. No. 793,529, filed Oct. 31, 1985 now abandoned.

TECHNICAL FIELD AND BACKGROUND ART

The invention relates to aqueous high sudsing liquid detergent compositions containing specified amounts and types of surfactants especially useful in the washing of tableware, kitchenware and other hard surfaces.

The compositions of this invention have superior ability to handle grease.

The performance of a detergent composition for cleaning tableware and kitchen utensils is evaluated by its ability to handle grease. The detergent solution should readily remove grease and minimize its redeposition.

There is continuing need for improved compositions and methods which can be employed during dishwashing operations to improve the appearance of kitchen utensils and articles. Such compositions and methods should provide improved removal of grease in conventional dishwashing soil removal operations while maintaining the sudsing attributes of an acceptable dishwashing detergent composition.

SUMMARY OF THE INVENTION

The present invention comprises a high sudsing liquid detergent composition containing by weight:

(a) from about 5% to about 50% anionic surfactant;

(b) from about 0.1% to about 12% of polymeric surfactant having the formula selected from the group consisting of $A_nBA_m$, $B_nAB_m$, BA, B and mixtures thereof wherein each B is a hydrophobic group; each A is a hydrophilic group; each n and m are either 0 or an integer from one to about 50; the sum of n+m is from one to about 50; the molecule contains from about 5 to about 1,000 ether linkages; when the formula is BA, B contains from about 5 to about 500 ether linkages; when the formula is B, the ratio of $—CH_2—$ groups to ether linkages is at least about 2.1:1 and less than about 3:1; the molecular weight is from about 400 to about 60,000; and the percentage of $+C_2H_4O+$ groups in the molecule is less than about 90%;

(c) from 0% to about 10% of a suds stabilizing nonionic surfactant selected from the group consisting of fatty acid amides, trialkyl amine oxides and mixtures thereof;

(d) from 0% to about 10% of a detergency builder selected from inorganic phosphates, inorganic polyphosphates, inorganic silicates, and inorganic carbonates, organic carboxylates, organic phosphonates, and mixtures thereof;

(e) from 0% to about 15% alkanol containing from one to about six carbon atoms; and (f) from about 20% to about 90% water, said composition containing sufficient magnesium ions to neutralize at least about 10% of said anionic surfactant when less than about 10% of the anionic surfactant is an alkylpolyethoxylate sulfate surfactant containing from about ½ to about ten ethoxy groups per molecule on the average (or there is no betaine surfactant present); said composition having a pH of greater than about six when the composition contains said alkylpolyethoxylate sulfate surfactant; said composition having a viscosity of greater than about 100 cps or being substantially free of alkylpolyethoxylate detergent surfactants when the amount of anionic surfactant is less than about 20% (and there is no betaine surfactant present).

Dishware, glassware, and other tableware and kitchenware are washed in water solutions of the detergent composition, generally at a weight concentration of from about 0.05% to about 0.4% of the composition in water at a temperature of from about 60° F. to about 120° F.

DETAILED DESCRIPTION OF THE INVENTION

The liquid detergent compositions of the present invention contain two essential components:

(a) anionic surfactant which when there is no betaine surfactant present is either a magnesium salt and/or an alkylpolyethoxylate sulfate containing an average of from about ½ to about ten ethoxy groups per molecule, said average being computed herein by treating any alkyl sulfate surfactant as an alkylpolyethoxylate sulfate containing 0 ethoxy groups, as described hereinbefore, to provide good sudsing, and preferably a low interfacial tension; and (b) the polymeric surfactant, which improves grease handling.

Optional ingredients can be added to provide various performance and aesthetic characteristics.

Anionic Surfactant

The compositions of this invention contain from about 5% to about 50% by weight of an anionic surfactant or mixtures thereof preferably comprising at least about 5%, more preferably at least about 8%, and most preferably more than about 10% of an alkyl polyethoxylate (polyethylene oxide) sulfate having from about 10 to about 20, preferably from about 10 to about 16 carbon atoms in the alkyl group and containing from about ¼ to about 10, preferably from about 1 to about 8, most preferably from about 1 to about 6 ethoxy groups on the average. Preferred compositions contain from about 20% to about 40% of anionic surfactant by weight.

Most anionic detergents can be broadly described as the water-soluble salts, particularly the alkali metal, alkaline earth metal, ammonium or amine salts, of organic sulfuric reaction products having in their molecular structure an alkyl radical containing from about 8 to about 22 carbon atoms and a radical selected from the group consisting of sulfonic acid and sulfuric acid ester radicals. Included in the term "alkyl" is the alkyl portion of acyl radicals. Examples of the anionic synthetic detergents which can form the surfactant component of the compositions of the present invention are the salts of compatible cations, e.g. sodium, ammonium, monoethanolammonium, diethanolammonium, triethanolammonium, potassium and/or, especially, magnesium cations with: alkyl sulfates, especially those obtained by sulfating the higher alcohols ($C_8$–$C_{18}$ carbon atoms), alkyl benzene, or alkyl toluene, sulfonates, in which the alkyl group contains from about 9 to about 15 carbon atoms, the alkyl radical being either a straight or branched aliphatic chain; paraffin sulfonates or olefin sulfonates in which the alkyl or alkenyl group contains from about 10 to about 20 carbon atoms; sodium $C_{10-20}$ alkyl glyceryl ether sulfonates, especially those ethers of alcohols derived from tallow and coconut oil; coconut oil fatty acid monoglyceride sulfates and sulfonates; alkylphenolpolyethylene oxide ether sulfates with from about 1 to about 10 units of ethylene oxide per molecule on the average in which the alkyl radicals contain from 8 to about 12 carbon atoms; the reaction products of fatty acids esterified with isethionic acid where, for example, the fatty acids are derived from coconut oil; fatty acid amides of a methyl tauride in which the fatty acids, for example, are derived from coconut oil; and beta-acetoxy- or beta-acetamido-alkanesulfonates where the alkane has from 8 to 22 carbon atoms.

Specific examples of alkyl sulfate salts which can be employed in the instant detergent compositions include sodium, potassium, ammonium, monoethanolammonium, diethanolammonium, triethanolammonium, and magnesium: lauryl sulfates, stearyl sulfates, palmityl sulfates, decyl sulfates, myristyl sulfates, tallow alkyl sulfates, coconut alkyl sulfates, $C_{12-15}$ alkyl sulfates and mixtures of these surfactants. Preferred alkyl sulfates include the $C_{12-15}$ alkyl sulfates.

Suitable alkylbenzene, or alkyltoluene, sulfonates include the alkali metal (lithium, sodium, and/or potassium), alkaline earth (preferably magnesium), ammonium and/or alkanolammonium salts of straight, or branched-chain, alkylbenzene, or alkyltoluene, sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids as precursors of the alkyl-benzene sulfonates useful for compositions herein are those in which the alkyl chain is linear and averages about 11 to 13 carbon atoms in length. Examples of commercially available alkyl benzene sulfonic acids useful in the present invention include Conoco SA 515 and SA 597 marketed by the Continental Oil Company and Calsoft LAS 99 marketed by the Pilot Chemical Company.

The preferred anionic surfactants herein, which are essential if there are no, e.g., magnesium ions or betaine surfactant present, are alkylpolyethoxylate sulfates having the formula $RO(C_2H_4O)_xSO_3M$ wherein R is alkyl, or alkenyl, of from about 10 to about 20 carbon atoms, x is from about ½ to about ten on the average, treating alkyl sulfates as if they had 0 ethoxy groups, preferably from about ½ to about eight, most preferably from about one to about six, and M is a water-soluble compatible cation such as those disclosed hereinbefore. The alkylpolyethoxylate sulfates useful in the present invention are sulfates of condensation products of ethylene oxide and monohydric alcohols having from about 10 to about 20 carbon atoms. Preferably, R has 10 to 16 carbon atoms. The alcohols can be derived from natural fats, e.g., coconut oil or tallow, or can be synthetic. Such alcohols can be reacted with from about ½ to about 20, especially from about one to about 14, and more especially from about one to about eight, molar proportions of ethylene oxide and the resulting mixture of molecular species is sulfated and neutralized.

There should be more than about 10%, preferably more than about 15% of such molecules containing one to 10 ethoxylate groups calculated as a percentage of the total anionic surfactant in the composition. When these molecules are mixed with alkyl sulfates which are treated as containing 0 ethoxylate groups, the computed average degree of ethoxylation should be more than about 0.5, preferably more than about 0.6. One can use a similar approach in computing the minimum desired amount of the alkyl polyethoxylate sulfate which should be present when admixed with any anionic surfactant. E.g. the other anionic surfactant can be treated as if it were an alkyl sulfate to compute the average degree of ethoxylation.

Specific examples of alkylpolyethoxylate sulfates of the present invention are sodium coconut alkylpolyethoxylate (3) ether sulfate, magnesium $C_{12-15}$ alkylpolyethoxylate (3) ether sulfate, and sodium tallow alkylpolyethoxylate (6) ether sulfate. A particularly preferred example is a water soluble, e.g. magnesium, $C_{12-13}$ alkylpolethoxylate (1) ether sulfate. Preferred alkyl polyethoxylate sulfates are those comprising a mixture of individual compounds, said mixture having an average alkyl chain length of from about 10 to 16 carbon atoms and an average degree of ethoxylation of from about 1 to about 8 moles of ethylene oxide.

For use in completely soft water, the compositions should contain magnesium ions, and/or at least about 10%, preferably at least about 15% by weight of the anionic surfactant, of the preferred alkyl polyethoxylate sulfates described hereinbefore. It is preferred that the compositions of this invention, including those that contain the preferred alkylpolyethoxylate sulfates, also contain magnesium and/or calcium ions, most preferably magnesium ions, to act as cations for a portion of the anionic surfactant. If the composition is to be used primarily in water containing more than about 2 grains/gal. of hardness, added magnesium may not be essential. In use, from about 10% to about 100%, preferably from about 20% to about 90%, of the anionic surfactant should be the magnesium salt.

The formulation of anionic surfactant systems that will reduce the interfacial tension is well within the skill of the typical detergent formulator. For the purposes of this invention, the surfactant system minus the polymeric surfactant should preferably reduce the interfacial tension to below about 2½ dyne/cm, preferably below about 2 dynes/cm, against triolein at a concentration of 0.2% and a temperature of 115° F. (46° C.) in a spinning drop Tensiometer. Interfacial tension is lowered by any detergent surfactant, but the efficiency can be improved by selection of surfactants which have longer alkyl chain lengths, use of cations such as magnesium which minimize charge effects when anionic surfactants are used, and use of anionic surfactants combined with cosurfactants like trialkylamine oxides which form complexes with the anionic surfactant. A more complete discussion of such effects can be found in Milton J. Rosen, Surfactants and Interfacial Phenomena, 149–173 (1978), incorporated herein by reference.

The Polymeric Surfactant

Preferably, the compositions of the present invention contain from about 0.1% to about 10%, more preferably from about ½% to about 4%, and most preferably from about ½% to about 2%, of the polymeric surfactant described generically hereinbefore and discussed in detail hereinafter.

In the generic formula for the polymeric surfactant set forth hereinbefore, B is preferably a polypropylene oxide group, containing more than about 5 propylene oxide groups, which can contain some ethylene oxide groups, n and m are preferably from about 1 to about 2 and the sum of n+m is from about 2 to about 4, the molecule contains from about 20 to about 500 ether linkages, and the molecular weight is from about 1,000 to about 40,000.

The polymeric surfactant is preferably represented by the formula:

$$[R^1\text{-}(R^2O)_n\text{-}(R^3O)_m]_y[R^4]$$

wherein each $R^1$ is selected from the group consisting of hydrogen, alkyl groups containing from one to about 18 carbon atoms, acyl groups containing from two to about 18 carbon atoms, $-SO_4M$, $-SO_3M$, $-COOM$, $-N(R^5)_2\rightarrow O$, $-N(R^5)_3^{(+)}$, amide groups, pyrollidone groups, saccharide groups, and hydroxy groups in which each M is a compatible cation and each $R^5$ is either an alkyl or hydroxy alkyl group containing from one to about four carbon atoms; wherein each $R^2$ or $R^3$ is an alkylene group containing from two to about six carbon atoms with no more than about 90% of said molecule comprising $R^2$ and $R^3$ groups containing two carbon atoms; wherein $R^4$ is selected from the group consisting of alkylene groups containing from one to about 18 carbon atoms and having from two to about six valences, polyhydroxyalkylene oxide groups wherein each alkylene group has from one to about six hydroxy groups and contains from three to about eight carbon atoms and there are from two to about 50 hydroxyalkylene oxide groups and from two to about 50 hydroxy groups, $(=NR^2N=)$, hydrogen, $=N-R^2NH-_x$, polyester groups containing from one to about 20 ester linkages and each ester group containing from about 4 to about 18 carbon atoms; wherein n is from 0 to about 500, m is from 0 to about 500, n+m is from about 5 to about 1000, x is from about 2 to about 50, and y is from one to about 50 and equal to the valences of $R^4$; wherein the molecular weight is from about 400 to about 60,000; and wherein the $-(R^2O)-$ and the $-(R^3O)-$ groups are interchangeable;

While not wishing to be bound by theory, it is believed that the polymeric surfactant functions by forming complexes with the hydrophilic portions of the anionic surfactants, thereby minimizing the ability of the anionic surfactants to leave a micelle or other interfacial region once formed. Therefore, long terminal hydrocarbon groups are not preferred, and are not acceptable when the formula is of the BA type. Long terminal hydrocarbons pull the polymer into any oil phase, thereby minimizing the number of anionic surfactant molecules that are stabilized. Similarly, if the hydrophilic portion of the molecule is too hydrophilic, the molecule is pulled into the aqueous phase too far. The molecule should be balanced between hydrophobicity and hydrophilicity and have enough ether and/or amine linkages spread throughout the structure to complex the anionic surfactant. The anionic surfactant also must be one that will form the complex. Magnesium cations, ether linkages, and amine or ammonium groups form stable complexes with the polymeric surfactants.

Preferably the surfactant contains a hydrophilic group comprising polyethylene oxide and/or ethyleneimine groups containing from about 1 to about 500 ethylene oxide and/or ethyleneimine derived moieties. Sulfonate or sulfate groups, can also be present. The polymeric surfactant also contains at least one hydrophobic group, preferably comprising polyalkylene oxide groups wherein the alkylene contains from three to about six, most preferably three, carbon atoms and the molecular weight is from about 400 to about 60,000. The alkylene groups containing from about 7 to about 18, preferably from about 10 to about 18, carbon atoms can also be used, but preferably only short chain relatively nonoleophilic alkyl or acyl groups containing less than about ten carbon atoms are pendant on the polymeric surfactant.

Preferred surfactants are block copolymers comprising one or more groups that are hydrophilic and which contain mostly ethylene oxide groups and one or more hydrophobic groups which contain mostly propylene oxide groups attached to the residue of a compound that contained one or more hydroxy or amine groups onto which the respective alkylene oxides were polymerized, said polymers having molecular weights of from about 400 to about 60,000, an ethylene oxide content of from about 10% to about 90% by weight and a propylene oxide content of from about 10% to about 90% by weight.

Preferred surfactants are those in which propylene oxide is condensed with an amine, especially ethylenediamine to provide a hydrophobic base having a molecular weight of from about 350 to about 55,000, preferably from about 500 to about 40,000. This hydrophobic base is then condensed with ethylene oxide to provide from about 10% to about 90%, preferably from about 20% to about 80% ethylene oxide. Reverse structures in which the ethylene oxide is condensed first are also desirable. These structures are especially easy to formulate into desirable single phase liquid compositions.

Similar structures in which the ethylenediamine is replaced by a polyol, especially propylene glycol, or glycerine, or condensation products of glycerine, are also desirable.

In similar compositions, the polypropylene glycol portion can be replaced by an alkyl, or alkylene group containing from about 5 to about 18, preferably from about 8 to about 16 carbon atoms and the polyethylene oxide groups can be replaced either totally, or, preferably in part, by other water solubilizing groups, especially sulfate and sulfonate groups.

Specific examples of such compounds include:

$$R^1(OCH_2CH_2)_xR^2(OCH_2CH_2)_yOR^1 \qquad \text{A.}$$

where:

$R^1$ is H, or $CH_3$, or $CH_3(CH_2)_n$, or unsaturated analogues where:

n=1-17 x,y=2-500

$R^2$=nothing or $O(CH_2)_z$ or unsaturated analogue of these where z=1-18

$$R^3R^4(OCH_2\overset{\overset{CH_3}{|}}{C}H)_AR^4R^3 \qquad \text{B.}$$

where:

$R^3$ is sulfate or sulfonate $R^4$ is nothing; $-(OCH_2CH_2)-$ or other groups capable of bonding to propylene oxide, including sulfate or sulfonate groups.

A is 5-500

B<A/2

Specific preferred examples of such compounds include:

$$H\text{-}(OCH_2CH_2)_x O(CH_2)_z(OCH_2CH_2)_y HCH_3(CH_2)_n(OCH_2CH_2)_{x+y} O(CH_2)_n CH_3$$

C.

$$NaO_3S\text{-}(OCH_2\overset{\overset{CH_3}{|}}{C}H)_A OSO_3Na$$

D.

$$NaO_3S\text{-}(OCH_2CH_2)_B(OCH_2\overset{\overset{CH_3}{|}}{C}H)_A(OCH_2CH_2)_B OSO_3Na$$

where:

x, y, z, n, A, B are as previously defined.

Suds Stabilizing Nonionic Surfactant

The compositions of this invention contain from 0% to about 10%, preferably from about 1% to about 8%, of suds stabilizing nonionic surfactant or mixtures thereof.

Suds stabilizing nonionic surfactants operable in the instant compositions are of two basic types: fatty acid amides and the trialkyl amine oxide semi-polar nonionics.

The amide type of nonionic surface active agent includes the ammonia, monoethanol and diethanol amides of fatty acids having an acyl moiety of from about 8 to about 18 carbon atoms and represented by the general formula:

$$R^1\text{—}CO\text{—}N(H)_m(R^2OH)_{2-m}$$

wherein $R_1$ is a saturated or unsaturated, aliphatic hydrocarbon radical having from 7 to 21, preferably from 11 to 17 carbon atoms; $R^2$ represents a methylene or ethylene group; and m is 1 or 2. Specific examples of said amides are coconut fatty acid monoethanol amide and dodecyl fatty acid diethanol amide. These acyl moieties may be derived from naturally occurring glycerides, e.g., coconut oil, palm oil, soybean oil and tallow, but can be derived synthetically, e.g., by the oxidation of petroleum, or hydrogenation of carbon monoxide by the Fischer-Tropsch process. The monoethanol amides and diethanolamides of $C_{12-14}$ fatty acids are preferred.

Amine oxide semi-polar nonionic surface active agents comprise compounds and mixtures of compounds having the formula:

$$R^1(C_2H_4O)_n\overset{\overset{R^2}{|}}{\underset{\underset{R^3}{|}}{N}}\longrightarrow O$$

wherein $R^1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R^2$ and $R^3$ are each a methyl, ethyl, propyl, isopropyl, 2-hydroxyethyl, 2-hydroxypropyl, or 3-hydroxypropyl radical and n is from 0 to about 10. Particularly preferred are amine oxides of the formula:

$$R^1\text{—}\overset{\overset{R^2}{|}}{\underset{\underset{R^3}{|}}{N}}\longrightarrow O$$

wherein $R^1$ is a $C_{10-14}$ alkyl and $R^2$ and $R^3$ are methyl or ethyl.

The preferred sudsing characteristics of the compositions of the invention are those which will provide the user of the product with an indication of cleaning potential in a dishwashing solution. Soils encountered in dishwashing act as suds depressants and the presence or absence of suds from the surface of a dishwashing solution is a convenient guide to product usage. Mixtures of anionic surfactants and suds stabilizing nonionic surfactants are utilized in the compositions of the invention because of their high sudsing characteristics, their suds stability in the presence of food soils and their ability to indicate accurately an adequate level of product usage in the presence of soil.

In preferred embodiments of the invention, the ratio of anionic surfactants to suds stabilizing nonionic surfactants in the composition will be in a molar ratio of from about 11:1 to about 1:1, and more preferably from about 8:1 to about 3:1.

Other Optional Surfactants

The compositions of the invention can desirably contain optional surfactants, especially ampholytic and/or zwitterionic surfactants. However, when the level of anionic surfactant is less than about 20%, the composition should not contain any substantial amount of conventional nonionic surfactant, e.g., an alkylpolyethoxylate, in addition to the polymeric surfactant. Large amounts of conventional nonionic surfactants, e.g., more than about three or four percent, tend to harm the sudsing ability of the composition.

When larger amounts (>20%) of anionic surfactants are present it is sometimes desirable to have a low level, up to about 5%, of conventional nonionic surfactants "conventional" nonionic surfactants are, e.g., $C_{8-18}$ alkyl polyethoxylates (4–15) or $C_{8-15}$ alkyl phenol polyethoxylates (4–15).

Ampholytic surfactants can be broadly described as derivatives of aliphatic amines which contain a long chain of about 8 to 18 carbon atoms and an anionic water-solubilizing group, e.g. carboxylate, sulfonate or sulfate. Examples of compounds falling within this definition are sodium-3-dodecylamino propane sulfonate, and dodecyl dimethylammonium hexanoate.

Zwitterionic surface active agents operable in the instant composition are broadly described as internally-neutralized derivatives of aliphatic quaternary ammonium and phosphonium and tertiary sulfonium compounds in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

Highly preferred are betaine detergent surfactants which synergistically interact with the polymeric surfactant to provide improved grease handling.

The Betaine Detergent Surfactant

The betaine detergent surfactant has the general formula:

$$R\text{—}\overset{(+)}{N}(R^6)_2R^7\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^6$ is an alkyl group containing from one to about 3 carbon atoms; and $R^7$ is an alkylene group containing from one to about 6 carbon atoms.

Examples of preferred betaines are dodecylamidopropyl dimethylbetaine; dodecyldimethylbetaine; tetradecyldimethylbetaine; cetyldimethylbetaine; cetylamidopropyldimethylbetaine, tetradecyldimethylbetaine, tetradecylamidopropyldimethylbetaine, and docosyldimethylammonium hexanoate and mixtures thereof.

Betaine surfactants are unique ingredients that provide exceptional benefits. When betaine surfactant and polymeric surfactant are combined with any anionic surfactant with, or without magnesium ions being present, superior grease holding benefits are provided.

Betaines containing a $C_{12-14}$ alkyl provide a much bigger benefit when combined with polymeric surfactant than when used by themselves.

The betaine is preferably present at a level of from about ½% to about 15% by weight of the formula, preferably from about 1% to about 10%, most preferably from about 1% to about 8%. The ratio of anionic detergent surfactants to the betaine is from about 1 to about 80, preferably from about 1 to about 40, more preferably from about 2 to about 40.

When betaines are present, the composition should preferably have a ratio of betaine to polymeric surfactant of more than about 7:1, preferably more than about 9:1.

Solvents

Alcohols, such as ethyl alcohol, and hydrotropes, such as sodium and potassium toluene sulfonate, sodium and potassium xylene sulfonate, trisodium sulfosuccinate and related compounds (as disclosed in U.S. Pat. No. 3,915,903, incorporated herein by reference) and urea, can be utilized in the interests of achieving a desired product phase stability and viscosity. Alkanols containing from one to about six carbon atoms, especially two, and especially ethyl alcohol can be present. Ethyl alcohol at a level of from 0% to about 15%, preferably from about 1% to about 6%, and potassium and/or sodium toluene, xylene, and/or cumene sulfonates at a level of from about 1% to about 6% can be used in the compositions of the invention. The viscosity should be greater than about 100 centipoise, more preferably more than 150 centipoise, most preferably more than about 200 centipoise for consumer acceptance.

However the polymeric surfactant can be used to reduce the viscosity and provide phase stability, e.g., when either the preferred alkyl polyethoxylate sulfate or magnesium ions are present in the composition. For viscosity reduction, the percentage of ethylene oxide in the polymer should be less than about 70%, preferably less than about 50%. Preferred compositions contain less than about 2% alcohol and less than about 3% hydrotrope and preferably essentially none while maintaining a viscosity of from about 150 to about 500 centipoise, preferably from about 200 to about 400 centipoise. If viscosity reduction is not desired the percentage of ethylene oxide in the polymer should be more than about 50%, preferably more than about 70%. The polymeric surfactant reduces viscosity for all water soluble anionic surfactants.

The compositions of this invention contain from about 20% to about 90%, preferably from about 30% to about 80%, water.

Additional Optional Ingredients

The compositions of this invention can contain up to about 10%, by weight of detergency builders either of the organic or inorganic type. Examples of water-soluble inorganic builders which can be used, alone or in admixture with themselves and organic alkaline sequestrant builder salts, are alkali metal carbonates, phosphates, polyphosphates, and silicates. Specific examples of such salts are sodium tripolyphosphate, sodium carbonate, potassium carbonate, sodium pyrophosphate, potassium pyrophosphate, and potassium tripolyphosphate. Examples of organic builder salts which can be used alone, or in admixture with each other or with the preceding inorganic alkaline builder salts, are alkali metal polycarboxylates, e.g., water-soluble citrates, tartrates, etc. such as sodium and potassium citrate and sodium and potassium tartrate. In general, however, detergency builders have limited value in dishwashing detergent compositions and use at levels above about 10% can restrict formulation flexibility in liquid compositions because of solubility and phase stability considerations. It is preferred that any builder used be relatively specific to control of calcium as opposed to magnesium. Citrates, tartrates, malates, maleates, succinates and malonates are especially preferred.

The detergent compositions of this invention can contain, if desired, any of the usual adjuvants, diluents and additives, for example, perfumes, electrolytes, enzymes, dyes, antitarnishing agents, antimicrobial agents, and the like, without detracting from the advantageous properties of the compositions. Alkalinity sources and pH buffering agents such as monoethanolamine, triethanolamine and alkali metal hydroxides can also be utilized.

When the anionic surfactant is a sulfate surfactant or alkylpolyethoxylate sulfate surfactant, the pH should be above about 6, preferably above about 7 to avoid hydrolysis of the ester linkage. Also, it is desirable that the composition be substantially free of antibacterial agents such as N-trichloromethyl-thio-4-cyclohexene-1,2,dicarboximide for safety.

Low levels of antibacterial agents that will prevent growth of bacteria, molds, etc. in the product, but which have essentially no effect in use can be desirable, especially when low levels of alcohol are present.

All percentages and ratios herein are by weight unless otherwise indicated.

The following examples are given to illustrate the compositions of the invention.

In the following examples, the compounds have the following definitions. E stands for an ethoxylate group and P stands for a propoxylate group.

| Name | Formula | MW | HLB |
|---|---|---|---|
| Pluronic 38 | $E_{45.5}P_{17}E_{45.5}$ | 5000 | 30.5 |
| Pluronic 41* | $E_{1.5}P_{22}E_{1.5}$ | 1400 | 4 |
| Pluronic 42 | $E_{3.5}P_{22}E_{3.5}$ | 1630 | 8 |
| Pluronic 45* | $E_{13.5}P_{22}E_{13.5}$ | 2400 | 18 |
| Pluronic 47* | $E_{36.5}P_{22}E_{36.5}$ | 4600 | 26 |
| Pluronic 68 | $E_{76}P_{29}E_{76}$ | 8350 | 29 |
| Pluronic 81 | $E_3P_{41.5}E_3$ | 2750 | 2 |
| Pluronic 82* | $E_{7.5}P_{41.5}E_{7.5}$ | 3200 | 6 |

-continued

| | | | |
|---|---|---|---|
| Pluronic 85 | $E_{26}P_{41.5}E_{26}$ | 4600 | 16 |
| Pluronic 87 | $E_{61}P_{41.5}E_{61}$ | 7700 | 24 |
| Pluronic 88 | $E_{98}P_{41.5}E_{98}$ | 10800 | 28 |
| Pluronic 108 | $E_{127.5}E_{48}E_{127.5}$ | 14000 | 27 |
| Pluronic 121 | $E_5P_{70}E_5$ | 4400 | .5 |
| Pluronic 122* | $E_{11}P_{70}E_{11.5}$ | 5000 | 4 |
| Pluronic 125* | $E_{51.5}P_{70}E_{51.5}$ | 9100 | 15 |
| Pluronic 127 | $E_{99.5}P_{70}E_{99.5}$ | 12500 | 22 |
| Pluronic 17R4 | $P_{14}E_{24.5}P_{14}$ | 2700 | 16 |
| Tetronic 504 | $(E_8P_{8.5})_4(=NCH_2CH_2N=)$ | 3400 | 15.5 |
| Tetronic 702 | $(E_{4.5}P_{14})_4(=NCH_2CH_2N=)$ | 4000 | 7 |
| Tetronic 704 | $(E_{12.5}P_{14})_4(=NCH_2CH_2N=)$ | 5500 | 15 |
| Tetronic 707 | $(E_{47.5}P_{14})_4(=NCH_2CH_2N=)$ | 12000 | 27 |
| Tetronic 902* | $(E_6P_{17})_4(=NCH_2CH_2N=)$ | 5300 | 6.5 |
| Tetronic 904* | $(E_{17}P_{17})_4(=NCH_2CH_2N=)$ | 7500 | 14.5 |
| Tetronic 907* | $(E_{55}P_{17})_4(=NCH_2CH_2N=)$ | 13900 | 26 |
| Tetronic 908 | $(E_{91}P_{17})_4(=NCH_2CH_2N=)$ | 20000 | 30.5 |
| Tetronic 1307 | $(E_{74}P_{24})_4(=NCH_2CH_2N=)$ | 18600 | 23.5 |
| Tetronic 1502* | $(E_{10}P_{31})_4(=NCH_2CH_2N=)$ | 9000 | 5 |
| Tetronic 1504 | $(E_{28.5}P_{31})_4(=NCH_2CH_2N=)$ | 12500 | 13 |
| Tetronic 70R4 | $(P_{14}E_{12.5})_4(=NCH_2CH_2N=)$ | 5500 | |

| Name | Definition |
|---|---|
| Compound A | Polyethyleneimine (MW = 600) condensed with 42 mols of polypropylene oxide followed by 42 mols of polyethylene oxide |
| Compound B | Polyethyleneimine (MW = 600) condensed with 14 mols of polypropylene oxide |
| Compound C | Polyethyleneimine (MW = 600) condensed with 42 mols of polypropylene oxide |
| Compound D | Polyethyleneimine (MW = 600) condensed with 98 mols of polypropylene oxide |
| Plurocol W5100 | "Random" copolymer of ethylene oxide (50%) and propylene oxide (50%) (MW = 4600) (BASF) |
| Compound E | Pluronic 81 di-sulfated and $NH_4OH$ neutralized |
| Compound F | $HO(C_2H_4O)_{18}(CH_2)_{12}O(C_2H_4O)_{18}H$ |
| PPG 4000 | Polypropylene glycol MW = 4000 |
| PEG 6000 | Polyethylene glycol MW = 6000 |
| Compound G | Polyethyleneimine (MW = 189) acylated with 2 mols of coconut fatty acid and condensed with 80 mols of ethylene oxide |
| Compound H | Polyethyleneimine (MW = 189) condensed with 105 mols of ethylene oxide |
| Compound I | Methyl capped hexamethylenediamine condensed with 60 mols of ethylene oxide |
| Compound J | Triethanol amine condensed with 15 mols of ethylene oxide |
| Compound K | Triethanol amine condensed with 33 mols of ethylene oxide |
| Compound L | Dobanol 91-10 $CH_3(CH_2)_{8-10}O(CH_2CH_2O)_{10}H$ |
| Compound M | 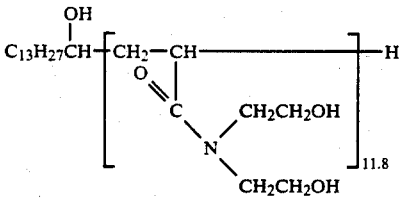 |
| Compound N | $CH_3(CH_2)_{11-12}O-CH(OH)-CH_2(OH)$ |
| Compound O | $CH_3-O(CH_2CH_2O)_{43}(CH_2CH(CH_3)O)_{43}H$ |
| HA-430 | Polyethylene glycol/polypropylene glycol heteric block copolymer (BASF) |

*Prepared by blending other commercially available materials.

The base product contains about 5% magnesium $C_{12-13}$ alkyl sulfate, about 23% mixed magnesium and ammonium $C_{12-13}$ alkyl polyethoxylate (1) sulfate, about 2.7% $C_{12-13}$ alkyl dimethyl amine oxide, about 5% ethyl alcohol, about 3% sodium toluene sulfonate, about 60% water, and the balance being inorganic salts, minor ingredients, etc.

In the following examples, "grease cutting" is determined by the following test. A preweighed 250 cc. polypropylene cup has 3 cc. of a melted beef grease applied to its inner bottom surface. After the grease has solidified, the cup is reweighed. Then a 0.4% aqueous solution of the composition to be tested is added to the cup to completely fill it. The aqueous solution has a temperature of 46° C. After 15 minutes, the cup is emptied and rinsed with distilled water. The cup is dried and then weighed to determine the amount of grease removal. The amount removed by the base product is indexed at 100.

In the following examples, "grease capacity" is determined by modifying the above grease cutting test by using 10 ml of an easier to remove fat which is an 80/20 mixture of a solid vegetable shortening and a liquid vegetable shortening, lowering the detergent concentration to about 0.2%, and soaking for 30 minutes to allow equilibrium to occur.

In the Examples "*" indicates a significant difference and the figures in parentheses under the headings "Grease Capacity" and "Grease Cutting" are the number of replicates run and averaged to give the indicated test scores.

In all of the Examples, the viscosity of the composition is greater than about 150 centipoise and less than about 500 centipoise.

EXAMPLE I

This test shows the improvement in grease capacity and grease cutting obtainable with various Pluronics.

| | Grease Capacity | Grease Cutting | Total |
|---|---|---|---|
| IA | | | |
| | (4) | (5) | — |
| Base Product | 100 | 100 | 200 |
| Base Product + 1.3% Pluronic 127 | 125* | 116* | 241* |
| Base Product + 1.3% Pluronic 47 | 129* | 119* | 248* |
| Base Product + 1.3% Pluronic 87 | 123* | 111* | 234* |
| Base Product + 1.3% Pluronic 122 | 124* | 108* | 232* |
| Base Product + 1.3% Pluronic 42 | 128* | 124* | 252* |
| Base Product + 1.3% Pluronic 82 | 124* | 120* | 244* |
| Base Product + 1.3% Pluronic 125 | 130* | 112* | 242* |
| Base Product + 1.3% Pluronic 45 | 134* | 119* | 253* |
| Base Product + 1.3% Pluronic 85 | 129* | 120* | 249* |
| $LSD_{10}$ | 8 | 8 | 11 |
| IB | | | |
| | (3) | (3) | |
| Base Product | 100 | 100 | 200 |
| Base Product + 1.3% Pluronic 121 | 113* | 104* | 217* |
| Base Product + 1.3% Pluronic 81 | 112* | 106* | 218* |
| Base Product + 1.3% Pluronic 41 | 109 | 113* | 222* |
| Base Product + 1.3% Pluronic 85 | 116* | 110 | 226* |
| $LSD_{10}$ | 10 | 11 | 15 |
| IC | | | |
| | (3) | (2) | — |
| Base Product | 100 | 100 | 200 |
| Base Product + 1.3% Pluronic 38 | 113* | 102 | 215* |
| Base Product + 1.3% Pluronic 68 | 118* | 101 | 219* |
| Base Product + 1.3% Pluronic 88 | 116* | 93 | 209 |
| Base Product + 1.3% Pluronic 108 | 125* | 93 | 218* |
| $LSD_{10}$ | 10 | 13 | 15 |

EXAMPLE II

This test shows the improvement obtained with various Tetronics.

| | Grease Capacity | Grease Cutting | Total |
|---|---|---|---|
| IIA | | | |
| | (6) | (5) | — |
| Base Product | 100 | 100 | 200 |
| Base Product + 1.3% Tetronic 504 | 108* | 116* | 224* |
| Base Product + 1.3% Tetronic 702 | 113* | 113* | 226* |
| Base Product + 1.3% Tetronic 707 | 108* | 111* | 219* |
| Base Product + 1.3% Tetronic 902 | 120* | 104 | 224* |
| Base Product + 1.3% Tetronic 904 | 108* | 99 | 207 |
| Base Product + 1.3% Tetronic 907 | 113* | 108* | 221* |
| Base Product + 1.3% Tetronic 1502 | 111* | 108* | 219* |
| Base Product + 1.3% Tetronic 1504 | 106* | 111* | 217 |
| Base Product + 1.3% Tetronic 1307 | 108* | 97 | 205 |
| $LSD_{10}$ | 6 | 8 | 10 |
| IIB | | | |
| Reps | (3) | (2) | — |
| Base Product | 100 | 100 | 200 |
| Base Product + 1.3% Tetronic 908 | 121* | 87 | 208 |
| $LSD_{10}$ | 10 | 13 | 15 |

EXAMPLE III

This example demonstrates that reversing the order of addition of the ethylene oxide and propylene oxide to create a hydrophilic center and hydrophobic ends provides compounds which are equally as effective as the Pluronics or Tetronics.

| | Grease Capacity | Grease Cutting | Total |
|---|---|---|---|
| | (4) | (4) | — |
| Base Product | 100 | 100 | 200 |
| Base Product + 1.3% Pluronic 85 | 121* | 98 | 219* |
| Base Product + 1.3% Pluronic 17R4 | 125* | 94 | 219* |
| Base Product + 1.3% Tetronic 704 | 131* | 99 | 230* |
| Base Product + 1.3% Tetronic 70R4 | 129* | 96 | 225* |
| $LSD_{10}$ | 8 | 9 | 12 |

EXAMPLE IV

This example demonstrates that a polymeric surfactant with a somewhat hydrophilic center, two or more intermediate hydrophobic moieties and terminal hydrophilic moieties provides almost the same benefits as the Pluronics or Tetronics.

| | Grease Capacity | Grease Cutting | Total |
|---|---|---|---|
| | (9) | (5) | — |
| Base Product | 100 | 100 | 200 |
| Base Product + 1.3% Pluronic 85 | 108* | 105 | 213* |
| Base Product + 1.3% Tetronic 704 | 111* | 98 | 210* |
| Base Product + 1.3% Compound A | 116* | 100 | 216* |
| $LSD_{10}$ | 6 | 9 | 10 |

EXAMPLE V

This example demonstrates that a compound with a hydrophilic chain with grafted polypropylene oxide hydrophobic chains can provide grease capacity and grease cutting benefits about the same as Pluronics.

| | Grease Capacity | Grease Cutting | Total |
|---|---|---|---|
| | (5) | (4) | — |
| Base Product | 100 | 100 | 200 |
| Base Product + 1.3% Pluronic 85 | 112* | 102 | 214* |
| Base Product + 1.3% Compound B | 111* | 92 | 203 |

-continued

| | Grease Capacity | Grease Cutting | Total |
|---|---|---|---|
| Base Product + 1.3% Compound C | 109* | 92 | 201 |
| Base Product + 1.3% Compound D | 116* | 107 | 223* |
| $LSD_{10}$ | 7 | 10 | 12 |

EXAMPLE VI

This example shows that random structures of ethylene oxide and propylene oxide are as effective as their analog block structures.

| | Grease Capacity | Grease Cutting | Total |
|---|---|---|---|
| | (4) | (4) | — |
| Base Product | 100 | 100 | 200 |
| Base Product + 1.3% Pluronic 85 | 115* | 111* | 226* |
| Base Product + 1.3% Pluronic W5100 | 114* | 106 | 220* |
| $LSD_{10}$ | 8 | 10 | 13 |

EXAMPLE VII

This example shows that similar structures in which anionic moieties substitute, at least in part, for polyethoxylate moieties or alkylene chains are substituted, at least in part, for polypropoxylate moieties provide benefits similar to the Pluronics.

| | Grease Capacity | Grease Cutting | Total |
|---|---|---|---|
| | (7) | (5) | — |
| Base Product | 100 | 100 | 200 |
| Base Product + 1.3% Pluronic 65 | 107* | 103 | 210 |
| Base Product + 1.3% Compound E | 114* | 97 | 211* |
| Base Product + 1.3% Compound F | 110* | 98 | 209 |
| $LSD_{10}$ | 7 | 9 | 11 |

EXAMPLE VIII

This example demonstrates that mixtures of polypropylene glycol and polyethylene glycol, and the individual materials do not provide the benefits.

| | Grease Capacity | Grease Cutting | Total |
|---|---|---|---|
| | (2) | (2) | — |
| Base Product | 100 | 100 | 200 |
| Base Product + 0.65% PPG 4000(A) | 102 | 106 | 208 |
| Base Product + 0.65% PEG 6000(B) | 91 | 101 | 192 |
| Base Product + 0.65% A + 0.65% B | 99 | 101 | 200 |
| Base Product + 1.3% A | 95 | 104 | 199 |
| Base Product + 1.3% B | 89 | 98 | 187 |
| $LSD_{10}$ | 12 | 13 | 18 |

EXAMPLE IX

This example demonstrates that excessively water-soluble compounds and compounds which are more like conventional surfactants and contain terminal oleophilic hydrophobic groups do not provide the benefits.

| | Grease Capacity | Grease Cutting | Total |
|---|---|---|---|
| | (6) | (4) | — |

-continued

| | Grease Capacity | Grease Cutting | Total |
|---|---|---|---|
| Base Product | 100 | 100 | 200 |
| Base Product + 1.3% Compound G | 102 | 98 | 200 |
| Base Product + 1.3% Compound H | 102 | 93 | 195 |
| Base Product + 1.3% Compound I | 98 | 97 | 195 |
| Base Product + 1.3% Compound J | 99 | 96 | 195 |
| Base Product + 1.3% Compound K | 94 | 93 | 187* |
| Base Product + 1.3% Compound L | 93 | 95 | 188* |
| $LSD_{10}$ | 7 | 9 | 11 |

EXAMPLE X

This example is a continuation of Example IX.

| | Grease Capacity | Grease Cutting | Total |
|---|---|---|---|
| | (3) | (3) | — |
| Base Product | 100 | 100 | 200 |
| Base Product + 1.3% Methocel A15LV | 103 | 103 | 206 |
| Base Product + 1.3% $NH_4$ $C_{12-13}E_{12}SO_4$ | 96 | 98 | 194 |
| Base Product + 1.3% $NH_4C_{12-13}SO_4$ | 102 | 99 | 201 |
| Base Product + 1.3% $C_{12-13}N(CH_3)_2 \rightarrow O$ | 101 | 106 | 207 |
| Base Product + 1.3% Gelatin (Type A) | 106 | 96 | 202 |
| $LSD_{10}$ | 10 | 11 | 15 |

EXAMPLE XI

This example also demonstrates that other conventional surfactants do not provide the benefits.

| | Grease Capacity | Grease Cutting | Total |
|---|---|---|---|
| | (5) | (3) | — |
| Base Product | 100 | 100 | 200 |
| Base Product + 1.3% $C_{12-13}$ Glucoside (2) | 102 | 100 | 202 |
| Base Product + 1.3% Cn monoethanol amide | 104 | 101 | 205 |
| Base Product + 1.3% Compound M | 101 | 100 | 201 |
| Base Product + 1.3% Lexaine LM | 100 | 100 | 200 |
| Base Product + 1.3% Compound N | 99 | 100 | 199 |
| $LSD_{10}$ | 7 | 11 | 12 |

EXAMPLE XII

This example shows that some low molecular weight polypropylene oxides provide the benefit, although they do adversely affect sudsing.

| | Grease Capacity | Grease Cutting | Total |
|---|---|---|---|
| | (9) | (5) | — |
| Base Product | 100 | 100 | 200 |
| Base Product + 1.3% Pluronic 85 | 108* | 105 | 213* |
| Base Product + 1.3% PEG 6000 | 105 | 98 | 203 |
| Base Product + 1.3% PPG 4000 | 110* | 115* | 225* |
| $LSD_{10}$ | 6 | 9 | 10 |

EXAMPLE XIII

This example demonstrates yet another polymeric surfactant structure that is operable.

| | Grease Capacity | Grease Cutting | Total |
|---|---|---|---|
| | (5) | (4) | — |
| Base Product | 100 | 100 | 200 |
| Base Product + 1.3% Pluronic 85 | 112* | 102 | 214* |
| Base Product + 1.3% Compound O | 114* | 106 | 220* |
| $LSD_{10}$ | 7 | 10 | 12 |

EXAMPLE XIV

This example demonstrates that increasing the amount of the polymeric surfactant, a heteric block copolymer of ethylene oxide and propylene oxide on a glycerol base, improves Grease Capacity, but, eventually, lowers the Grease Cutting unacceptably. High levels above about 4%, and especially above about 9%, lose good grease cutting when the basic formula is optimized for grease cutting.

| | Grease Capacity | Grease Cutting | Total |
|---|---|---|---|
| | (3) | (3) | — |
| Base Product | 100 | 100 | 200 |
| Base Product + 1.3% HA 430 | 115* | 113 | 228* |
| Base Product + 16% HA 430 | 195* | 29* | 225* |
| $LSD_{10}$ | 10 | 11 | 15 |

EXAMPLE XV

This example, like Example XIV, shows the effect of increased (Tetronic) surfactant. Again, above about 4%, there is a loss which becomes substantial before a level of about 9% is reached.

| | Grease Capacity | Grease Cutting | Total |
|---|---|---|---|
| | (3) | (3) | — |
| Base Product | 100 | 100 | 200 |
| Base Product + 0.25% Tetronic 704 | 112* | 121* | 233* |
| Base Product + 0.50% Tetronic 704 | 118* | 119* | 237* |
| Base Product + 1.0% Tetronic 704 | 119* | 120* | 239* |
| Base Product + 4.0% Tetronic 704 | 136* | 96 | 232* |
| Base Product + 8.0% Tetronic 704 | 168* | 74* | 242* |
| Base Product + 16.0% Tetronic 704 | 221* | 47* | 268* |
| $LSD_{10}$ | 10 | 11 | 15 |

COMPARATIVE EXAMPLE XVI

This example shows the effect of using twice the amount of a commercial detergent. The Grease Capacity and Grease Cutting are increased, but at a much greater cost than associated with the invention.

| | Grease Capacity | Grease Cutting | Total |
|---|---|---|---|
| Reps | (4) | (4) | — |
| Base Product | 100 | 100 | 200 |
| Base Product (Double Usage) | 140* | 130* | 270* |
| $LSD_{10}$ | 8 | 10 | 13 |

EXAMPLE XVII

A high sudsing, light duty liquid detergent composition is as follows:

| | % |
|---|---|
| Sodium $C_{11.8}$ alkylbenzene sulfonate | 14.8 |
| Sodium $C_{12-13}$ alkylpolyethoxylate (0.8) sulfate | 17.3 |
| $C_{12-14}$ alkyldimethylbetaine | 1.5 |
| Pluronic 64 (as hereinafter defined) | 0.175 |
| $C_{10}$ alkylpolyethoxylate (8-10) | 4.7 |
| Coconut fatty acid monoethanol amide | 3.8 |
| Urea | 5.0 |
| Ethanol | 6.0 |
| Water and minors | Balance |

In a similar composition the urea is replaced by 4% sodium xylene sulfonate and the ethanol is reduced to 3.5%.

In a similar composition the Pluronic 64 is replaced by Pluronic 85.

EXAMPLE XVIII

| | Grease Capacity | Grease Cutting | Total |
|---|---|---|---|
| | (2) | (2) | — |
| Base Product | 100 | 100 | 200 |
| Base Product + 4½% Lexaine LM ½% Piuronic 85 | 134* | 134* | 268* |
| Base Product + 4¾% Lexaine LM ¼% Pluronic 85 | 98 | 138* | 236* |
| $LSD_{10}$ | 22 | 10 | 24 |

This example demonstrates the excellent performance of mixtures of betaine surfactants and the polymeric surfactants. At ratios up to about 20:1 grease cutting is improved, but the optimum ratio is lower, e.g. about 9:1 or less where both grease cutting and grease capacity are improved.

EXAMPLE XIX

| | % Ethoxylate | Viscosity Reduction (CPS) |
|---|---|---|
| Base Product (Viscosity - 270 centipoise) | — | Base |
| Base Product + ¼% Pluronic 121 | 10 | −62 |
| Base Product + ¼% Pluronic 123 | 30 | −40 |
| Base Product + ¼% Pluronic 127 | 70 | −30 |
| Base Product + ¼% Pluronic 72 | 20 | −55 |
| Base Product + ¼% Pluronic 75 | 50 | −41 |
| Base Product + ¼% Pluronic 77 | 70 | −31 |
| Base Product + ¼% Pluronic 61 | 10 | −70 |
| Base Product + ¼% Pluronic 63 | 30 | −59 |
| Base Product + ¼% Pluronic 64 | 40 | −59 |
| Base Product + ¼% Pluronic 68 | 80 | −20 |
| Base Product + ¼% Tetronic 1302 | 20 | −42 |
| Base Product + ¼% Tetronic 1304 | 40 | −32 |
| Base Product + ¼% Tetronic 1307 | 70 | −15 |

This example demonstrates the large reductions in viscosity obtained by adding the polymeric surfactant. The viscosity can be adjusted back up by reducing alcohol and/or hydrotrope levels. As can be seen, the higher the level of ethoxylate moieties in the polymers, the less the reduction in viscosity.

Additional Materials Description

| Name | Formula | MW | HLB |
|---|---|---|---|
| Pluronic 123 | $E_{45.5}\ P_{70}\ E_{45.5}$ | 5750 | 8 |
| Pluronic 72 | $E_{6.5}\ P_{36}\ E_{6.5}$ | 2750 | 6.5 |
| Pluronic 75 | $E_{23.5}\ P_{36}\ E_{23.5}$ | 4150 | 16.5 |

-continued

| Name | Formula | MW | HLB |
|---|---|---|---|
| Pluronic 77 | $E_{52.5}\ P_{36}\ E_{52.5}$ | 6600 | 24.5 |
| Pluronic 61 | $E_{2.5}\ P_{29}\ E_{2.5}$ | 2000 | 3 |
| Pluronic 63 | $E_9\ P_{29}\ E_9$ | 2650 | 11 |
| Pluronic 64 | $E_{13}\ P_{29}\ E_{13}$ | 2900 | 15 |
| Tetronic 1302 | $(E_9\ P_{24})_4$ (=$NCH_2CH_2$=) | 7800 | 5.5 |
| Tetronic 1304 | $(E_{24}\ P_{24})_4$ (=$NCH_2CH_2$=) | 10500 | 13.5 |

EXAMPLE XX

Polymer compounds are added at 0.5%, 1%, and 5% to the National Brand composition previously described, replacing water in the 100-part formula. Clear solutions result.

Viscosities are measured on these compositions at 70° F. with a Brookfield LVF viscometer, spindle No. 2, at 60 rpm.

Results are shown for the three additives and are compared against equal parts of added ethanol also replacing water in the formula. Ethanol is typically used to trim viscosity and is already present in the formula at about 4.5 parts/100 prior to the added parts.

Surprisingly, the addition of the polymers all drop the viscosity further than does the added ethanol. The Pluronic 61 is even more effective at 1% than is ethanol at 5%.

Viscosity of National Brand with Added Polymers

| | CPS Viscosity Additive Level: | | | |
|---|---|---|---|---|
| Additive Type | 0% | 0.5% | 1% | 5% |
| Compound H | 370 | 250 | 220 | NA |
| Pluronic 35 | 370 | NA | 195 | 113 |
| Pluronic 61 | 370 | NA | 163 | 83 |
| Ethanol | 370 | 275 | 240 | 190 |

In a similar manner, the national brand formula is composited with a 0.25% level of several Pluronic polymers. Viscosities are again read as above.

| Additive | Viscosity in Centipoise at 70° F. |
|---|---|
| None | 320 |
| Pluronic 65 | 265 |
| Pluronic 92 | 247 |
| Pluronic 42 | 237 |
| Pluronic 31 | 242 |

Note that the additive compounds provide different levels of viscosity reduction. The Compound H in the first experiment is one of the poorer (more hydrophilic) performers of Example IX and, though effective on viscosity reduction, did not show as great a benefit. The Pluronic compounds of lower HLB (lower second digit) and moderate molecular weight (first digit) are more effective. If the purpose for adding the polymer is to lower viscosity, lower levels provide the biggest benefit per part of polymer added.

EXAMPLE XXI

This test was conducted in water with no hardness.

| | Grease Capacity | Grease Cutting | Total |
|---|---|---|---|
| | (2) | (4) | — |

-continued

| | Grease Capacity | Grease Cutting | Total |
|---|---|---|---|
| A. Sodium coconut alkyl sulfate | 100 | 100 | 200 |
| B. A + 4.5% Lexaine LM + 0.5% Pluronic 85 | 215* | 106* | 321* |
| C. B + $MgCl_2$ to replace the sodium | 325* | 110* | 435* |
| D. 1:1 mixture of sodium coconut alkyl sulfate and sodium coconut alkyl polyethoxylate(1) sulfate | 96 | 98 | 194 |
| E. D + 4.5% Lexaine LM + 0.5% Pluronic 85 | 300* | 90* | 390* |
| F. E + $MgCl_2$ to replace the sodium | 266* | 114 | 380* |
| $LSD_{10}$ | 14 | 15 | 21 |

This example clearly shows that when a mixture of polymeric surfactant and betaine is used, it is not necessary to have either an alkyl polyethoxylate sulfate surfactant or magnesium ions present.

EXAMPLE XXII

| | Grease Capacity | Grease Cutting | Total |
|---|---|---|---|
| | (4) | (2) | — |
| National Brand | 100 | 100 | 200 |
| National Brand + 1.3% MAPEG 6000 DS | 112* | 99 | 211 |
| National Brand + 1.3% MAPEG 400 DS | 107 | 99 | 206 |
| National Brand + 1.3% MAPEG 400 DL | 112* | 101 | 213 |
| National Brand + 1.3% MAPEG 400 DO | 116* | 100 | 216* |
| $LSD_{10}$ | 8 | 13 | 15 |

Definition of Polymeric Surfactants
MAPEG 6000 DS (dialkyl polyethoxylate) $C_{18}E_{136}C_{18}$ 92% E
MAPEG 400 DS (dialkyl polyethoxylate) $C_{18}E_9C_{18}$ 44% E
MAPEG 400 DL (dialkyl polyethoxylate) $C_{12}E_9C_{12}$ 54% E
MAPEG 400 DO (dialkylene polyethoxylate) $C_{18}E_9C_{18}$ 45% E This example clearly shows that alkyl groups can be used as terminal hydrophobic groups, but do not provide the best results, especially when the hydrophilic portion of the molecule represents less than about 45% of the molecule weight in compounds with saturated groups each of which is longer than about 16 carbon atoms.

EXAMPLE XXIII

In this example, a different type of test was used to demonstrate another aspect of grease control by the detergent compositions. In most cases, this test gives a ranking between formulations similar to that of the total index value of the preceeding examples.

This test determines the effectiveness or strength of the grease emulsification by the detergent by measuring the level of grease deposition on a hydrophobic surface after its exposure to a detergent solution to which a grease has been added. This test models the actual situation of redeposition of greases onto later washed items, especially plastics.

For this experiment, 2 gallons of median hardness water (6 grains/gallon) were held at 105° F., a common end-of-wash temperature for dishwater. A 0.1% solution of the detergent product was made and mild agitation was begun. Liquid vegetable oil was added in 6 cc increments. At totals of 18 cc, 36 cc, and 54 cc, plastic items (3 for each grease level, 9 total) are dipped in succession into the water. After drying, the mean weight gain per plastic item unit area is calculated and indexed to a reference product.

The reference product used here is the base product. The polymeric surfactant is added at the 1% level to the base.

A "*" indicates a statistically significant ($LSD_{05}$) reduction in grease redeposition compared to the Base Product.

The compounds tested herein that were not previously defined are as follows:

Formula for P-T:

$$CH_3(OCH_2CH_2)_XOC(CH_2)_YCO(CH_2CH_2O)_XCH_3$$

| | |
|---|---|
| P | X = 8, Y = 4 |
| Q | X = 8, Y = 14 |
| R | X = 43, Y = 4 |
| S | X = 43, Y = 14 |
| T | X = 17, Y = 10 |

Formula for U and V:

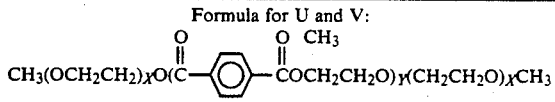

| | |
|---|---|
| U | X = 16, Y = 2.75 |
| V | X = 7.5, Y = 2.75 |

| | Deposition Index |
|---|---|
| Base Product | 100 |
| Base Product + 1% MAPEG 1540 DS | 79* |
| Base Product + 1% MAPEG 600 MO | 76* |
| Base Product + 1% MAPEG 600 DO | 75* |
| Base Product + 1% Pluronic 85 | 84* |
| Base Product + 1% Tetronic 704 | 107 |
| Base Product + 1% Methocel A15LV | 88 |
| Base Product + 1% Compound E | 84* |
| Base Product + 1% PPG 4000 | 64* |
| Base Product + 1% Compound F | 89 |
| Base Product + 1% Compound P | 84* |
| Base Product + 1% Compound Q | 80* |
| Base Product + 1% Compound R | 107 |
| Base Product + 1% Compound S | 117 |
| Base Product + 1% Compound T | 85* |
| Base Product + 1% Compound U | 71* |
| Base Product + 1% Compound V | 53* |

Note from the above that Tetronic 704 and Compound F did not excel in this test, but did perform well in the previous examples. Again, the Methocel polymer does not provide sufficient benefit.

Also, certain very high molecular weight compounds (R and S) of the ABA type do not show any advantage. Otherwise, all are exemplary of the invention.

PREFERRED PROCESS

When some of the compositions of this invention are first made, they are not at equilibrium. They typically require an aging period to reach equilibrium and exhibit the full benefit. A period of about two weeks, which is about equivalent to the normal time between making and use by the consumer is usually sufficient.

What is claimed is:

1. A high sudsing liquid dishwashing detergent composition containing by weight:

(a) from about 5% to about 50% anionic surfactant;

(b) from about 0.1% to about 10% of polymeric surfactant selected from the group consisting of:

$$[R^1—R^2O—_n—R^3O—_m]_y[R^4]$$

wherein each $R^1$ is hydrogen, wherein each $R^2$ or $R^3$ is an alkylene group containing from two to about six carbon atoms with no more than about 90% of said molecule comprising $R^2$ or $R^3$ groups containing two carbon atoms; wherein $R^4$ is selected from the group consisting of alkylene groups containing from one to about 18 carbon atoms and having from two to about six valences, $$\left(\overset{OH}{\overset{|}{}}\right)$$
$$\leftarrow CH_2CH_zCH_2O\rightarrow_x,$$

($=NR^2N=$), and $=N-R^2NH-_x$, wherein n is from 0 to about 500, m is from 0 to about 500, n+m is from about 5 to about 1000, x is from about 2 to about 50, and y is from two to about 50 and equal to the valences of $R^4$, and z is from 1 to about 6, and the product of z and x is from 2 to about 50;

$$R^1-OCH_2CH_2)_x-R^2-OCH_2CH_2-_yOR^1$$

where:

$R^1$ is H, or $CH_3$, or $CH_3(CH_2)_n$, or unsaturated analogues where:

n=1-17 each of x and y=2-500

$R^2=O(CH_2)_z$ or unsaturated analogue of these where z=1-18;

$$R^3R^4\leftarrow OCH_2\overset{CH_3}{\overset{|}{C}}H\rightarrow_A R^4R^3 \quad [3]$$

where:

$R^3$ is sulfate or sulfonate $R^4$ is nothing or $-OCH_2CH_2-_B$

A is 5-500

B<A/2;

$$CH_3(OCH_2CH_2)_XO\overset{O}{\overset{\|}{C}}(CH_2)_YC\overset{O}{\overset{\|}{O}}(CH_2CH_2O)_XCH_3 \quad [4]$$

wherein X is from 8-17, and Y is from 4-14; and

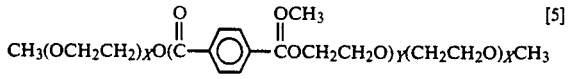

$$CH_3(OCH_2CH_2)_XO(C-\bigcirc-COCH_2CH_2O)_Y(CH_2CH_2O)_XCH_3 \quad [5]$$

wherein X is from 7.5-16, and Y is about 2.75;

(c) from about ½% to about 15% of betaine surfactant having the general formula:

$$\overset{(+)}{R}-N(R^5)_2R^6\overset{(-)}{C}OO$$

wherein R is a hydrophobic group selected from the group consisting of alkyl groups containing from about 10 to about 22 carbon atoms, alkyl aryl and aryl alkyl groups containing a similar number of carbon atoms with a benzene ring being treated as an equivalent to about 2 carbon atoms, similar structures in which the alkyl group is interrupted by amido, ether or ester linkages, and mixtures thereof, each $R^5$ is an alkyl group containing from 1 to about 3 carbon atoms; and $R^6$ is an alkylene group containing from 1 to about 6 carbon atoms;

(d) from 0% to about 10% of a suds stabilizing nonionic surfactant selected from the group consisting of fatty acid amides trialkyl amine oxides and mixtures thereof;

(e) from 0% to about 10% of a detergency builder selected from inorganic phosphates, inorganic polyphosphates, inorganic silicates, and inorganic carbonates, organic carboxylates, organic phosphonates and mixtures thereof;

(f) from 0% to about 15% alkanol containing from 1 to about 6 carbon atoms; and (g) from about 20% to about 90% water, the ratio of anionic surfactant to betaine surfactant being from about 2:1 to about 80:1 and the ratio of betaine surfactant to polymeric surfactant being greater than about 7:1.

2. The composition of claim 1 wherein there is from about ½% to about 4% polymeric surfactant.

3. The composition of claim 2 wherein the anionic surfactant is selected from the group consisting of sodium, ammonium, monoethanolammonium, diethanolammonium, triethanolammonium, potassium and magnesium salts of alkyl sulfates containing 8-18 carbon atoms, alkyl benzene sulfonates in which the alkyl group contains from about 9 to about 15 carbon atoms, and alkyl polyethoxylate sulfates in which the alkyl group contains from about 10 to about 20 carbon atoms and there are from about 1 to about 10 ethoxylate groups on the average, and mixtures thereof.

4. The composition of claim 3 wherein the betaine surfactant is present at a level of from about 1% to about 10% wherein the ratio of the anionic surfactant to the betaine surfactant is from about 2 to about 40.

5. The composition of claim 4 wherein the anionic surfactant is selected from the group consisting of alkyl benzene sulfonates in which the alkyl group contains from about 9 to about 15 carbon atoms, alkyl polyethoxylate sulfates in which the alkyl group contains from about 10 to about 16 carbon atoms and there are from about 1 to about 6 ethoxylate groups on the average, and mixtures thereof.

6. The composition of claim 2 wherein the polymeric surfactant has the formula:

$$[R^1\leftarrow R^2O\rightarrow_n\leftarrow R^3O\rightarrow_m]_y[R^4]$$

wherein each $R^1$ is hydrogen, wherein each $R^2$ or $R^3$ is an alkylene group containing from two to about six carbon atoms with no more than about 90% of said molecule comprising $R^2$ or $R^3$ groups containing two carbon atoms; wherein $R^4$ is selected from the group consisting of alkylene groups containing from one to about 18 carbon atoms and having from two to about six valences, poly (hydroxyalkylene oxide) groups wherein each alkylene group has from one to about six hydroxy groups and contains from three to about eight carbon atoms and there are from two to about 50 hydroxyalkylene oxide groups and from two to about 50 hydroxy groups, ($=NR^2N=$), hydrogen and $=N\leftarrow R^2NH\rightarrow_x$, wherein n is from 0 to about 500, m is from 0 to about 500, n+m is from about 5 to about 1000, x is from about 2 to about 50, and y is from one to about 50 and equal to the valences of $R^4$.

* * * * *